US006711860B2

(12) United States Patent
Fleishman

(10) Patent No.: US 6,711,860 B2
(45) Date of Patent: Mar. 30, 2004

(54) CONSTRUCTION PANEL INTERCONNECTION SYSTEM

(76) Inventor: Gregg R. Fleishman, 3850 Main St., Culver City, CA (US) 90232

( * ) Notice: Subject to any disclaimer, the term of this patent is extended or adjusted under 35 U.S.C. 154(b) by 269 days.

(21) Appl. No.: 09/779,902

(22) Filed: Feb. 8, 2001

(65) Prior Publication Data

US 2002/0104280 A1 Aug. 8, 2002

(51) Int. Cl.[7] ..... E04B 2/08

(52) U.S. Cl. ..... 52/81.3; 52/81.4; 52/592.1; 52/590.2; 52/284; 403/375; 446/113; 446/124

(58) Field of Search ..... 52/79.4, 81.3, 52/81.4, 81.5, 281, 284, 589.1, 590.1, 592.1, 592.4, 590.2, 590.3; 403/381, 282, 375; 446/112, 113, 124, 476, 478, 487; 472/136

(56) References Cited

U.S. PATENT DOCUMENTS

| | | | | | |
|---|---|---|---|---|---|
| 2,454,307 | A | * | 11/1948 | Cooley | 428/12 |
| 3,066,436 | A | | 12/1962 | Schuh | |
| 3,660,952 | A | | 5/1972 | Wilson | |
| 4,308,698 | A | | 1/1982 | Fleishman | |
| 4,406,562 | A | | 9/1983 | Nasi | |
| 4,454,678 | A | * | 6/1984 | Duvivier | 446/112 |
| 4,513,064 | A | * | 4/1985 | Marcus | 428/582 |
| 4,551,960 | A | | 11/1985 | Fleishman | |
| 4,950,508 | A | * | 8/1990 | Cherouse et al. | 428/12 |
| 5,400,918 | A | | 3/1995 | Prodaniuk | |
| 5,406,757 | A | | 4/1995 | Fleishman | |
| 5,505,025 | A | | 4/1996 | Fleishman | |
| 5,895,306 | A | * | 4/1999 | Cunningham | 446/108 |
| 6,173,538 | B1 | | 1/2001 | Fleishman | |

OTHER PUBLICATIONS

Pearce, Peter; "Structure in Nature is a Strategy for Design," pp. 48–49, 62–64 (MIT Press: Cambridge, MA, USA and London, England.) (1990).

Konrad Wachmann, "The Turning Point of Building," publ'd by Reinhold Publ'g Corp. United States, 1961, p.p. 141–146.

* cited by examiner

*Primary Examiner*—Brian E. Glessner
(74) *Attorney, Agent, or Firm*—Bruce A. Jagger

(57) ABSTRACT

A system for interconnecting construction panels suitable for modular construction has a hybrid connector, a receptor connector and locking connector. The hybrid connector is inserted into the aperture of the receptor connector which limit the displacement relative to each other. The locking connector is inserted into the aperture of the hybrid connector to interlock the three connectors. A panel connector can have an extension tab to provide additional locking action. Panel connectors can have stiffening portions that fill spaces between the connectors to reduce the need to insulate the interconnection and assist in repelling foreign matter entry. A method for interconnecting construction panels includes mating the hybrid connector and the receptor connector and then mating the locking connector from either side of the receptor connector.

21 Claims, 9 Drawing Sheets

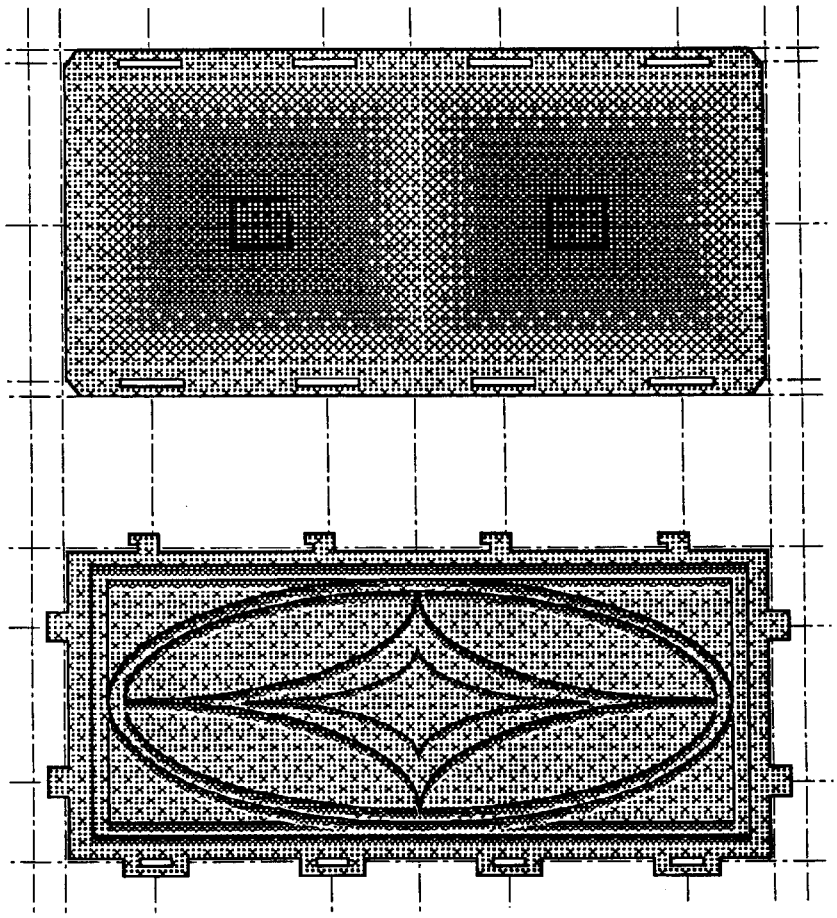
*Fig. 25a*
*Fig. 25b*
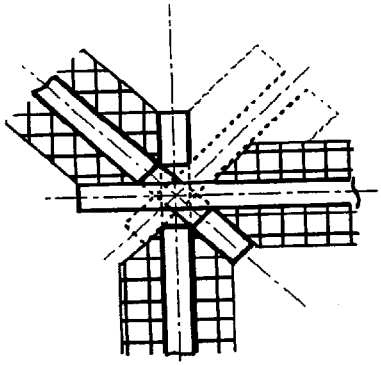
*Fig. 26*

CONSTRUCTION PANEL INTERCONNECTION SYSTEM

FIELD OF THE INVENTION

The present invention relates to the fields of residential or commercial structures, and models, toys, and play equipment. More specifically, it relates to the interconnection of panels for modular structures.

BACKGROUND OF THE INVENTION

The building industry today is dominated by conventional designs and construction practices. Conventional building techniques are very time-consuming, generally requiring a substantial amount of field labor. Moreover, mobilizing fabrication resources to the field is expensive. Conventional construction is also dominated by volumetric spaces bounded by rectangular or mixed rectangular-trapezoidal shapes.

Departures from conventional designs such as the "habitat" presented at the 1967 Montreal Expo, or a more geometrically sophisticated modular construction system as disclosed in U.S. Pat. No. 6,173,538 entitled "Modular Construction System" issued to Fleishman, which patent is hereby incorporated by reference as if fully set forth herein, attempts to simplify building construction while providing versatility and functionality. These modular construction designs often make use of standardized prefabricated units, commonly planar in configuration as to be used for walls, baseboards or ceilings, to simplify construction. Some modular designs call for interconnecting two planar units, while others call for interconnecting three planar units.

Construction using these standardized, prefabricated units or panels, however, continues to suffer from substantial limitations. Commonly, interconnecting these prefabricated units require the cumbersome step of aligning the long edges of the panels or walls, temporality holding them in place, and permanently securing the panels together using braces, screws, bolts or other fastening devices. Other times, a separate interconnecting part, providing grooves for the panels to fit into, is used to interconnect the prefabricated units. However, using these separate interconnecting parts still require more parts than the panels being interconnected and adds to the inventory of parts needed for a construction project. For a modular structure requiring interconnection of three panels, the assembly is even more cumbersome and costly as greater labor and number of parts are needed.

Accordingly, with the growing sophistication in modular design, there is a need for an improved assembly and method for joining or interconnecting two or three prefabricated units simply and effectively.

SUMMARY OF THE INVENTION

In a first separate aspect of the present invention, a system for interconnecting panels includes a hybrid connector, receptor connector, and locking connector. The hybrid connector has a tab that mates with an aperture of the receptor connector. The locking connector has a tab that mates with an aperture of the hybrid connector. As the connectors may be adapted to panels, mating the connectors interconnects the panels.

In a second separate aspect of the invention, the system for interconnecting panels of the first aspect of the invention further includes an extension tab lying orthogonal to the tab of the hybrid connector and/or the locking connector. The extension tab engages with the aperture of the corresponding connector so as to provide an additional locking action for interconnecting panels having panel connectors.

In a third separate aspect of the invention, a system for interconnecting panels includes hybrid, receptor and locking connectors having stiffening portions. The stiffening portions form interfitting profiles that fill the spaces between the three connectors which advantageously reduces the need to insulate the interconnection, assists in repelling foreign matter entry, and resists relative panel connector rotation where panel rotation is not needed during panel interconnection.

In a fourth separate aspect of the invention, a modular construction system includes panels having hybrid, receptor or locking connectors. The panels are interconnected such that a modular construction can be erected without the use of fastening devices.

In a fifth separate aspect of the present invention, a method for interconnecting panels for modular construction includes selecting panels having panel connectors, mating the hybrid connector to the receptor connector, and then mating the locking connector to the hybrid connector/receptor connector sub-assembly to interconnect the connectors attached to panels.

A sixth separate aspect of the present invention includes the combination of the foregoing aspects.

Other advantages will appear. The invention resides not only in the interconnection systems and methods to interconnect, but also in the construction of structures described and illustrated. The features shown with one embodiment may also be used with other embodiments.

BRIEF DESCRIPTION OF THE DRAWINGS

FIG. 25A is a plan view of a first construction panel having an artistic impression.

FIG. 25B is a plan view of a second construction panel having an alternate artistic impression.

FIG. 26 is a cross sectional view of a three-panel interconnection of panel connectors adapted to thicker panels.

DETAILED DESCRIPTION OF THE DRAWINGS

Figure 1:
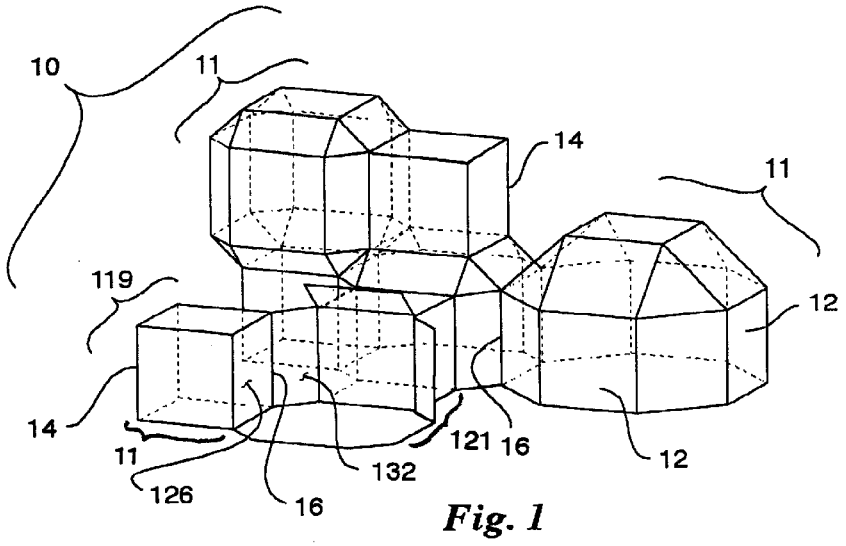
FIG. 1 is a perspective view of a modular construction structure.

Turning now in detail to the drawings, a system for interconnecting modular construction panels is disclosed. FIG. 1 shows a representative modular structure 10 comprising of a collection of modules 11, where each module 11 includes an interconnection of panels 12 by employing two-panel interconnections 14 and three-panel interconnections 16 according to the present invention to assemble the modular structure 10.

Figure 2:
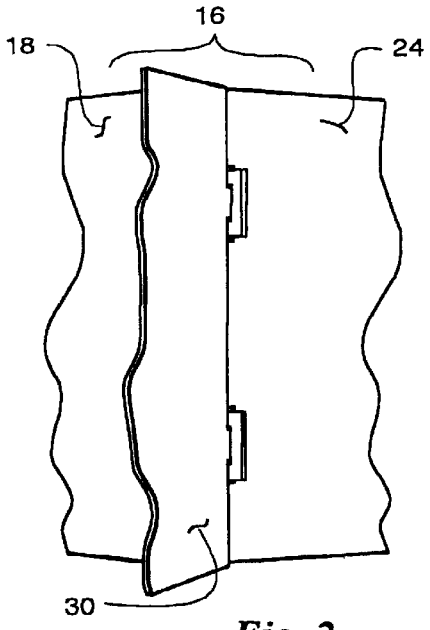
FIG. 2 is a perspective view of an assembled three-panel interconnection.
Figure 3:
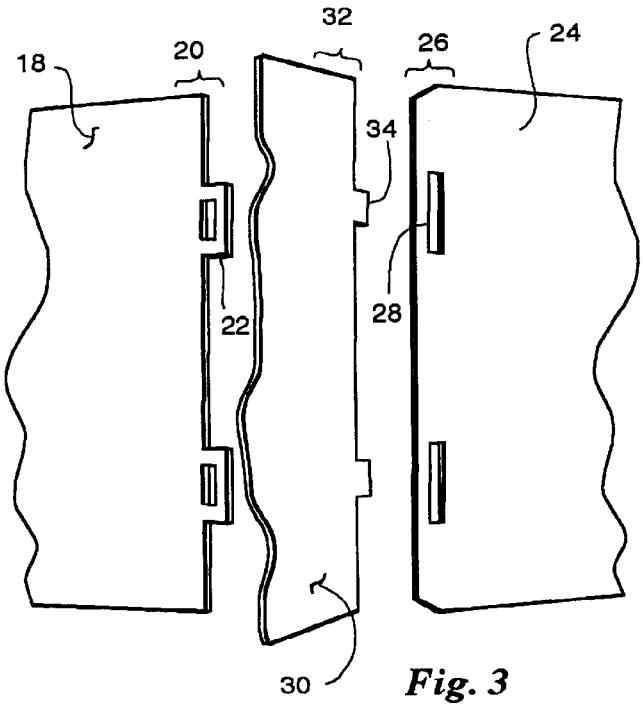
FIG. 3 is an exploded perspective view of the three-panel interconnection of FIG. 2.

FIG. 2 shows an enlarged view of an assembled three-panel interconnection 16 according to the present invention. Referring to FIG. 3, an exploded view of the three-panel interconnection 16 shows more clearly a first embodiment of the present invention comprising a first panel 18 that includes a hybrid connector 20, where the hybrid connector 20 has hybrid connector element 22; a second panel 24 that includes a receptor connector 26, where the receptor connector 26 has a receptor element 28; and a third panel 30 that includes a locking connector 32, where the locking connector 32 has a locking element 34.

Throughout the specification, the hybrid connector 20, receptor connector 26, and locking connector 32 will generally and collectively be referred to as "panel connectors." Panel connectors may or may not be adapted to a construction panel. Panel connectors adapted to a segment and not to a panel, as will be described in more detail below, will generally and collectively be referred to as "stand-alone panel connectors." Finally, a hybrid connector element 22, receptor element 28 and locking element 34, as will be described in more detail below, will generally and collectively be referred to as "connector elements."

Figure 4:
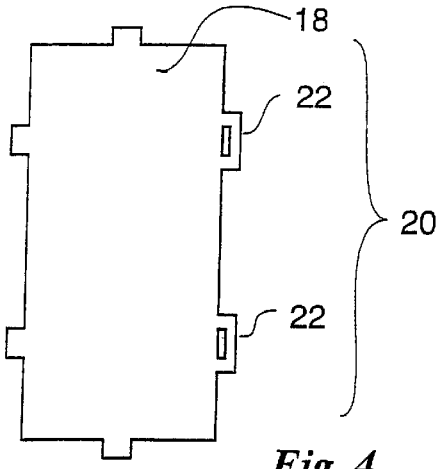
FIG. 4 is a front view of a panel including a hybrid connector.

Referring to FIG. 4, a front view of the first panel 18 shows a hybrid connector 20 adapted to the panel along a panel perimeter. The hybrid connector 20 includes at least one hybrid connector element 22. In the arrangement shown, the hybrid connector 20 has two hybrid connector elements 22.

Figure 5:
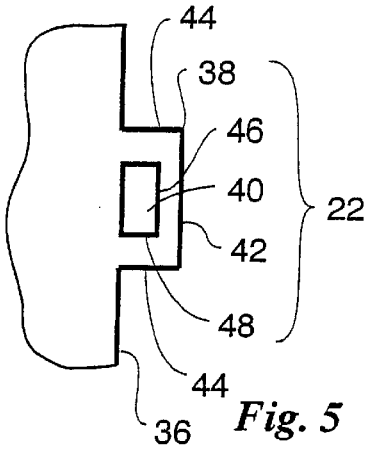
FIG. 5 is an expanded front view of a hybrid connector element of the hybrid connector of FIG. 4.

FIG. 5 is an expanded view of an exemplary hybrid connector element 22. The hybrid connector element 22 has a base edge 36, a protruding tab 38 and an aperture 40. The protruding tab 38 is preferably rectangular in shape, having an outer edge 42 and side edges 44. The outer edge 42 is substantially parallel to and offset from the base edge 36. The side edges 44 are substantially orthogonal to the base edge 36.

A hybrid connector aperture 40 is defined within the protruding tab 38. The aperture 40 is preferably rectangular in shape, having long edges 46 and short edges 48. The long edges 46 are substantially parallel to and offset from the base edge 36. The short edges 48 are substantially orthogonal to the base edge 36.

Figure 6:
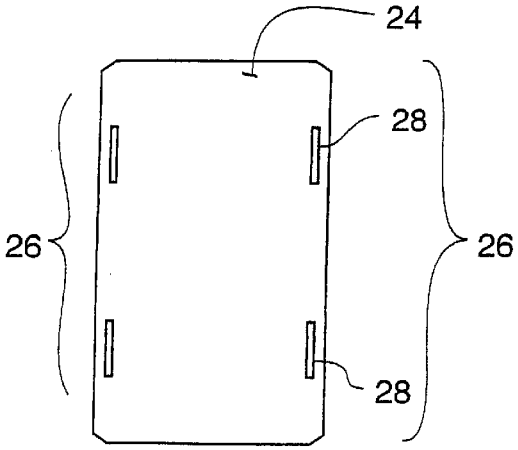
FIG. 6 is a front view of a panel including a receptor connector.

Referring to FIG. 6, a front view of the second panel 24 shows two receptor connectors 26 adapted to opposing perimeters on the second panel. The receptor connector 26 includes at least one receptor element 28. In the arrangement shown, each receptor connector 26 has two receptor elements 28.

Figure 7A:
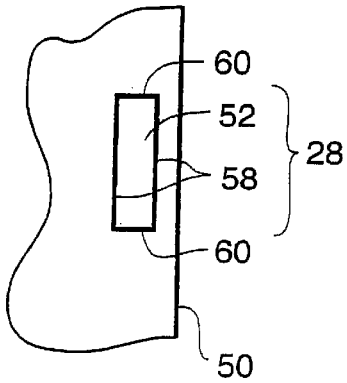
FIG. 7A is an expanded front view of a receptor element of the receptor connector of FIG. 6.
Figure 7B:
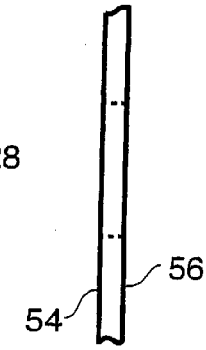
FIG. 7B is an end view of the receptor element of FIG. 7A.

FIG. 7A shows an expanded front view and FIG. 7B shows the end view of a receptor element 28. The receptor element 28 as shown has a base edge 50, an aperture 52, a first side 54 and a second side 56. The receptor aperture 52 is preferably rectangular in shape and includes long edges 58 and short edges 60. The long edges 58 are substantially parallel to and offset from the base edge 50. The short edges 60 are substantially orthogonal to the base edge 50. The receptor aperture 52 is sized such that the hybrid connector protruding tab 38 can be inserted into the receptor aperture 52 from the first side 54, and fit sufficiently through the receptor aperture 52 such that the hybrid connector aperture 40 is accessible from the second side 56 of the receptor connector 26.

Figure 8:
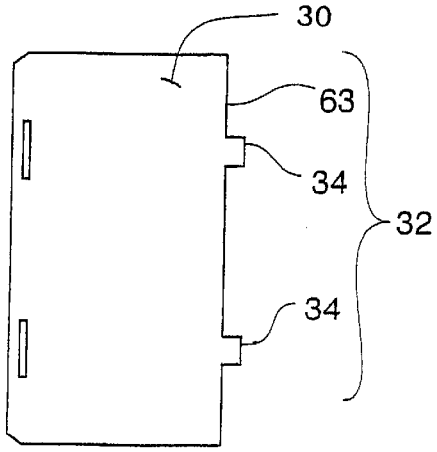
FIG. 8 is a front view of a panel including a locking connector.

Referring to FIG. 8, a front view of the third panel 30 shows the locking connector 32 adapted to a perimeter of the third panel 30. The locking connector 32 includes at least one locking element 34. In the arrangement shown, the locking connector 32 has two locking elements 34.

Figure 9A:
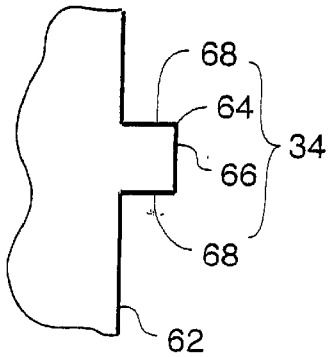
FIG. 9A is an expanded front view of a locking element of the locking connector of FIG. 8.

FIG. 9A shows an expanded view of a locking element 34. The locking element 34 has a base edge 62 and a protruding tab 64. The protruding tab 64 is preferably rectangular in shape, having an outer edge 66 and side edges 68. The outer edge 66 is substantially parallel to and offset from the base edge 62. The side edges 68 are substantially orthogonal to the base edge 62. The protruding tab 64 of the locking connector 32 is sized such that it may fit sufficiently into and through the hybrid connector aperture 40.

Figure 10A:
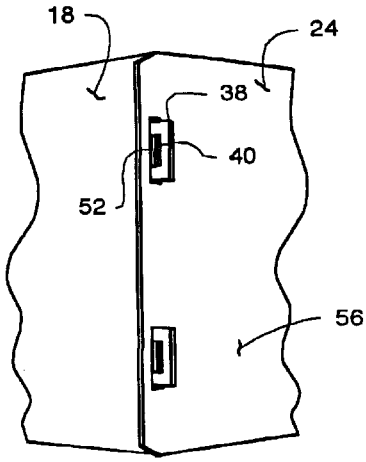
FIG. 10A is a perspective view of a first panel having a hybrid connector mated with a second panel having a receptor connector.
Figure 10B:
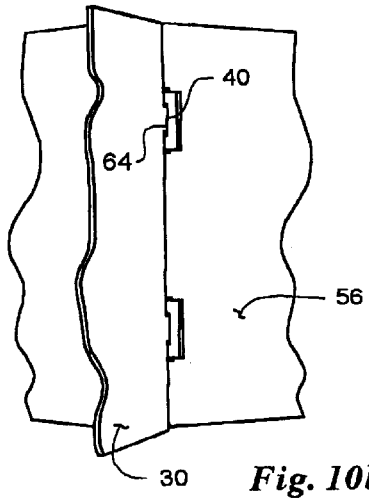
FIG. 10B is a perspective view of a third panel having a locking connector mated with the first and second panels of FIG. 10A.
Figure 11A:
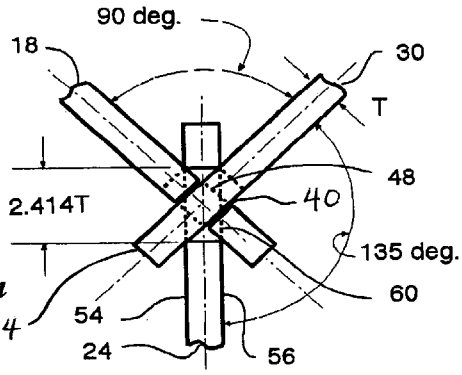
FIG. 11A is a cross sectional view of a three-panel interconnection.

In a first method of interconnecting the three panels, the first panel 18 having the hybrid connector 20 is mated with the second panel 24 having the receptor connector 26 by inserting the hybrid connector protruding tab 38 into the receptor aperture 52 as shown in FIG. 10A. To properly mate, the hybrid connector protruding tab entering from the first side 54 of the receptor connector 26 must be positioned through receptor aperture 52 such that the hybrid connector aperture 40 is accessible from the second side 56 of the receptor connector 26. Referring now to FIGS. 10B and 11A, the third panel 30 having the locking connector 32 is then mated with the first panel/second panel sub-assembly by inserting the locking protruding tab 64 into the hybrid aperture 40 from the second side 56 of the receptor connector 26, thereby interconnecting the three panels.

Figure 10C:
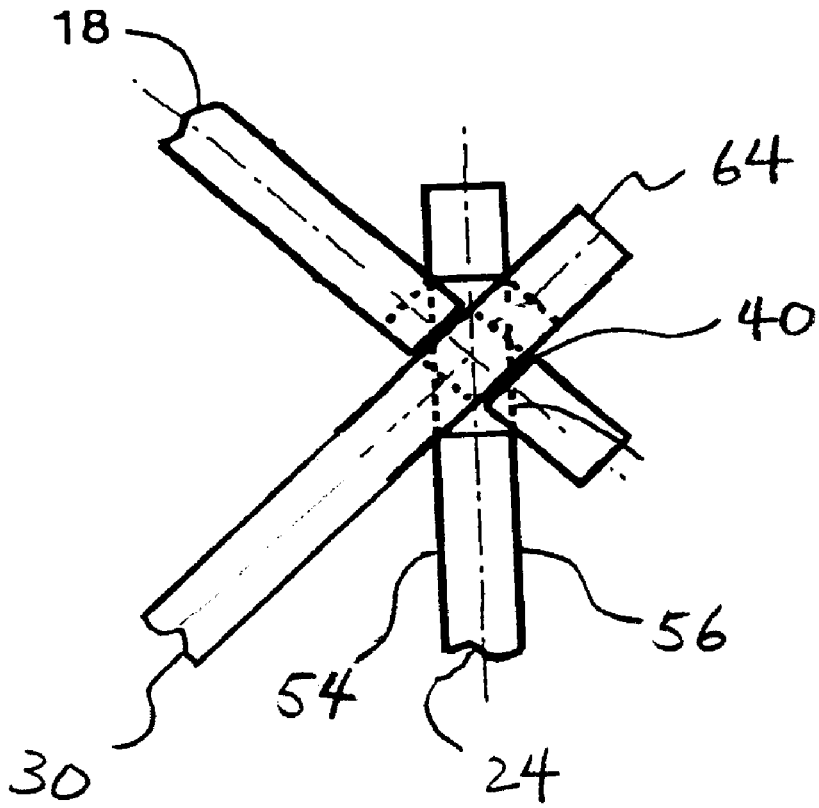
FIG. 10C is a cross sectional view of a third panel having a locking connector mated with the first and second panels of FIG. 10A.

In a second method of interconnecting the three panels, the first panel 18 is mated with the second panel 24 as described above and shown in FIG. 10A. However, the hybrid connector protruding tab entering from the first side 54 of the receptor connector 26 is positioned such that the hybrid connector aperture 40 is accessible from the first side 54. FIG. 10C illustrates a cross sectional view of an interconnection according to the second method where the third panel 30 having the locking connector 32 is then mated with the first panel/second panel sub-assembly by inserting the locking protruding tab 64 into the hybrid aperture 40 from the first side 54 of the receptor 26, thereby interconnecting the three panels.

Each panel connector described thus far have included two connector elements. However, a panel connector may have less or more connector elements for interconnecting purposes to accommodate small or large panels, or to achieve the desired panel interconnection stiffness. Additionally, though the connector elements are illustrated having a simple rectangular configuration, any shape suitable for mating as described above may be employed to practice the present invention. For example, as would be evident to those skilled in the art, an elliptical or oval shaped tab or aperture may be used to practice the invention. The simple rectangular configuration, however, advantageously reduces the cost to manufacture while effectively practicing the present invention.

Figure 9B:
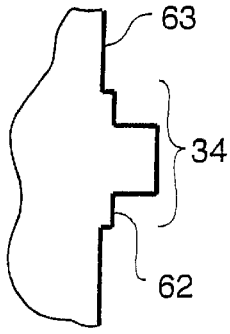
FIG. 9B is an expanded front view of a locking element having a base edge offset from the panel perimeter.

Moreover, though the base edge 36, 50, 62 of the connector elements are shown lying common to the perimeter edge of the panels, a base edge may lie separately from the perimeter edge. For example, as illustrated in FIG. 9B, the base edge 62 of the locking element 34 may be offset from the perimeter edge 63 of the third panel 30. Finally, a panel may have any combination of panel connector types adapted to its perimeters to practice the invention.

FIG. 11A illustrates a cross sectional view of an interconnection of a first panel 18 having a hybrid connector 20; a second panel 24 having a receptor connector 26; and a third panel 30 having a locking connector 32. The angular orientation between the first panel 18 and third panel 30 is approximately 90°. The angular orientation between the second panel 24 and the first panel 18, and between second panel 24 and the third panel 30, is approximately 135°. The relative angular orientation between the three panels, however, may be varied by adjusting the size of the hybrid connector aperture short edge 48 and/or the receptor aperture short edge 60, relative to the thickness of the hybrid connector protruding tab 38 and locking tab 64.

Figure 11B:
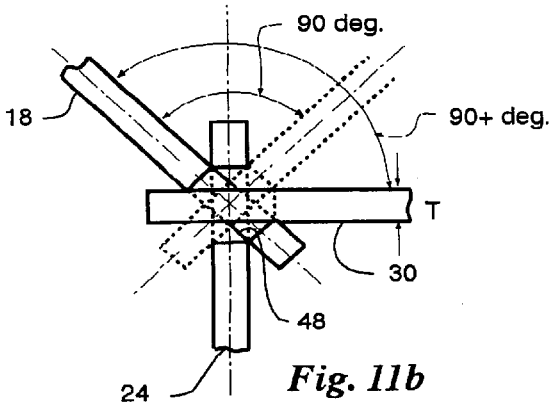
FIG. 11B is a cross sectional view of a three-panel interconnection, wherein the hybrid connector has an enlarged aperture.

For example, a system of panels may have a hybrid element and locking element protruding tab thickness of T. Where the short edge 48 of the hybrid connector aperture 40 is T, plus a small amount for clearance, the angular orientation between the first and third panel when mated is approximately 90° as shown in FIG. 11A. To increase the range of angular orientation between the first and third panels, the hybrid connector aperture short edge 48 may be increased. As shown in FIG. 11B, increasing the short edge 48 permits the possible angular orientation between the first and third panel to a value greater than 90°.

Figure 11C:
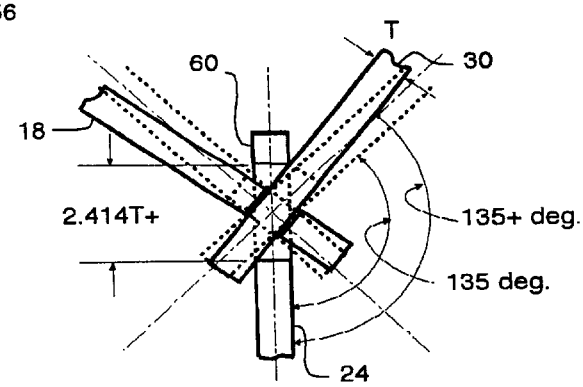
FIG. 11C is a cross sectional view of a three-panel interconnection, wherein the receptor connector has an enlarged aperture.

Similarly, the angular position of the first and third panels relative to the second panel 24 can be varied by adjusting the short edge 60 of the receptor aperture 52. Referring to FIG. 11A, a receptor aperture short edge value of 2.414 times T provides a symmetrical 135° orientation about the second panel. To increase the range of angular orientation, the short edge 60 may be increased. As shown in FIG. 11C, increasing the short edge 60 increases the possible angular orientation between the second and first panel, or between the second and third panel, to a value greater than 135°. As would be evident to those skilled in the art, increasing the size of both aperture short edges will provide even greater angular orientation range.

Figure 12:
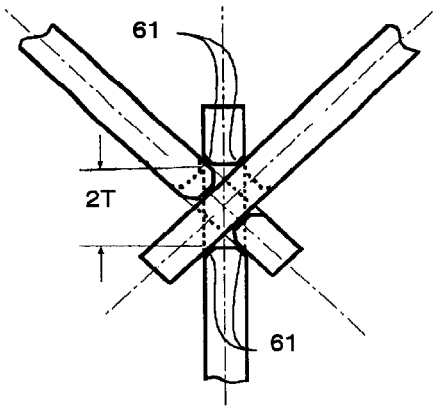
FIG. 12 is a cross sectional view of a three-panel interconnection, wherein the inner profile of the receptor aperture has a beveled edge.

Referring now to FIG. 12, adding a bevel edge 61 to the inner profile of the aperture 52 can advantageously reduce the short edge value needed to acquire the same angular orientation. For example, by providing a bevel 0.207 times T along the internal edge of the receptor aperture 52, the short edge 60 of the receptor aperture 52 can be reduced to 2 times T while still providing the symmetrical 135° orientation about the second panel 24. Adding the bevel edge improves the durability of the inner profile by removing the sharp edge corner. Also, by reducing the short edge 60, less material is removed from the receptor connector element 28 and, consequently, the stiffness and strength of the connector element is better retained.

With the configuration as above described, three panels may be interconnected without the use of fastening hardware or separate interconnecting devices. Additionally with the configuration as above described, the range of relative panel angles may be achieved by selectively sizing one or both short edges of the connector apertures. Furthermore, where either or both of receptor connector aperture 52 or hybrid connector aperture 40 is enlarged, clearance is provided where either the hybrid connector element 22 or the locking connector element 34 can be inserted into the corresponding aperture and then be rotated into place. This rotational flexibility advantageously assists during the panel interconnection process, especially where space is limited.

Figure 13A:
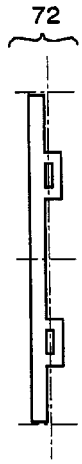
FIG. 13A is a plan view of a stand-alone hybrid connector.
Figure 13B:
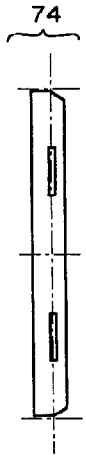
FIG. 13B is a plan view of a stand-alone receptor connector.
Figure 13C:
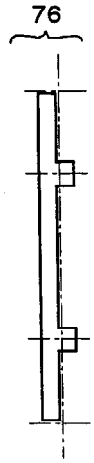
FIG. 13C is a plan view of a stand-alone locking connector.
Figure 14:
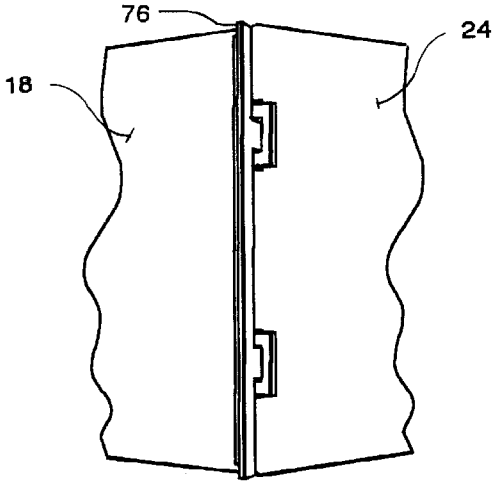
FIG. 14 is a perspective view of an assembled two-panel interconnection utilizing a stand-alone locking connector.

Moreover, where interconnection of two panels is desired, a stand-alone panel connector, i.e. a panel connector that is not adapted to a panel or other construction units, may be used. FIGS. 13A, 13B and 13C illustrate stand-alone hybrid connector 72, stand-alone receptor connector 74, and stand-alone locking connector 76, respectively. FIG. 14 illustrates a two-panel interconnection comprising a first panel 18 including a hybrid connector 20, a second panel 24 including a receptor connector 26, and stand-alone locking connector 76.

A second embodiment of the present invention comprises a system for interconnecting panels of the first embodiment including an enhanced hybrid connector 21, and/or an enhanced locking connector 77 in place of the standard hybrid connector 20 and/or the standard locking connector 32.

Figure 15A:
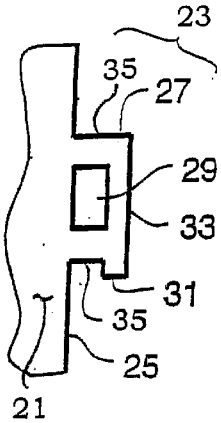
FIG. 15A is a plan view of an enhanced hybrid connector element.

The enhanced hybrid connector 21 includes an enhanced hybrid connector element 23 as shown in FIG. 15A. The enhanced hybrid connector element 23 has a base edge 25, protruding tab 27, aperture 29 and an extension tab 31. The protruding tab 27 and extension tab 31 are preferably rectangular in shape. The protruding tab 27 protrudes from the base edge 25 and includes an outer edge 33 and side edges 35. The outer edge 33 is substantially parallel to and offset from the base edge 25. The side edges 35 are substantially orthogonal to the base edge 25. The extension tab 31 extends from the protruding tab 27 substantially parallel to and offset from the base edge 25.

Figure 15B:
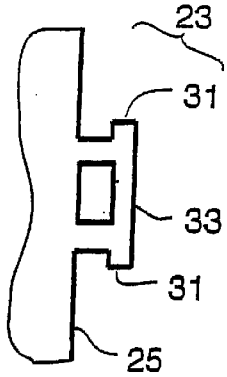
FIG. 15B is a plan view of an alternate enhanced hybrid connector element configuration.
Figure 15C:
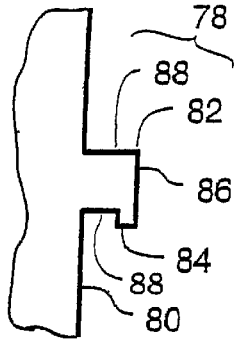
FIG. 15C is a plan view of an enhanced locking element.

Similarly, the enhanced locking connector 77 includes an enhanced locking element 78 as shown in FIG. 15C. The enhanced locking element 78 has a base edge 80, protruding tab 82 and an extension tab 84. The protruding tab 82 and extension tab 84 are preferably rectangular in shape. The protruding tab 82 protrudes from the base edge 80 and includes an outer edge 86 and side edges 88. The outer edge 86 is substantially parallel to and offset from the base edge 80. The side edges 88 are substantially orthogonal to the base edge 80. The extension tab 84 extends from the protruding tab 82 substantially parallel to and offset from the base edge 80.

Figure 16A:
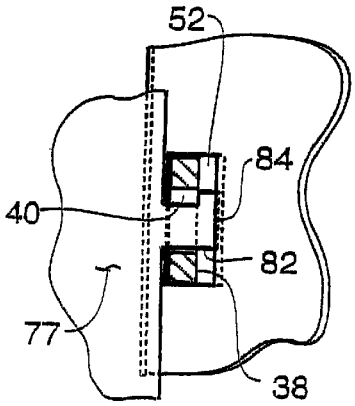
FIG. 16A is a cross-sectional view of a connection wherein an enhanced locking element is mated with the hybrid connector/receptor connector sub-assembly prior to engaging.
Figure 16B:
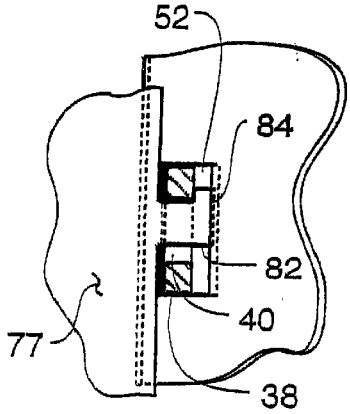
FIG. 16B is a cross-sectional view of the connection of FIG. 16A, wherein the enhanced locking element is engaged with the hybrid connector protruding tab.

The system for interconnecting panels according to the second embodiment comprises of a set of panel connectors that may include both enhanced hybrid connector and enhanced locking connector, or only one of the enhanced connectors in place of the standard panel connectors. To illustrate, an interconnection of panels utilizing a standard receptor connector 26, a standard hybrid connector 20, and an enhanced locking connector 77 will now be described. The mating of the hybrid connector with the receptor connector is as previously described for the first embodiment. The enhanced locking connector 77 then mates with the hybrid connector/receptor connector sub-assembly by orienting the protruding tab 82 and extension tab 84 into and through the hybrid connector aperture 40 such that the extension tab 84 is beyond the thickness of the hybrid connector protruding tab 38 as shown in FIG. 16A. The enhanced locking connector 77 is then laterally displaced such that the extension tab 84 engages with the hybrid connector protruding tab 38 as shown in FIG. 16B. With the configuration as described, engaging the extension tab 84 provides an additional locking action between the hybrid connector 20 and the locking connector 77 for interconnecting the panel connectors.

Where an enhanced hybrid connector 21 is used, the extension tab 31 is engaged to the receptor connector 26 in the same manner as described above for engaging the extension tab 84 of the enhanced locking tab 77 to the hybrid connector 20.

Figure 15D:
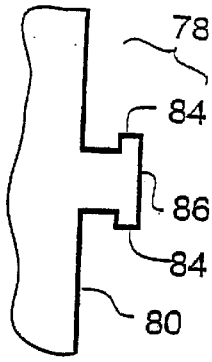
FIG. 15D is a plan view of an alternate enhanced locking element configuration.
Figure 17A:
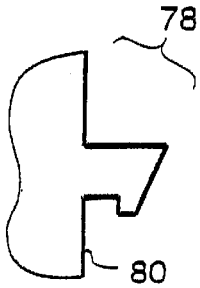
FIG. 17A is a view of an enhanced locking element having a tapered configuration.
Figure 17B:
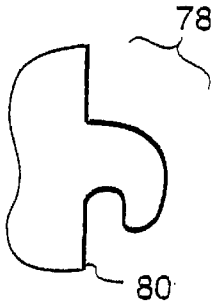
FIG. 17B is a schematic view of an enhanced locking element having a contoured configuration.

Referring to FIG. 15A, the enhanced hybrid connector element 23 shown has the extension tab edge farthest from its base edge 25 sharing a common edge with the outer edge 33 of the enhanced hybrid connector protruding tab 27. Similarly, referring to FIG. 15C, the enhanced locking element 78 shown has the extension tab edge farthest from the base edge 80 sharing a common edge with the outer edge 86 of the locking connector protruding tab 82. The extension tabs 31, 84 are also shown being rectangular and co-planar with the protruding tab of the connector element. The additional locking action capability of the enhanced panel connector however is not limited to a single co-planar, orthogonal, rectangular extension tab. Although a single extension tab 31, 84 has been disclosed, the enhanced connector elements 23, 78 may have multiple extension tabs as shown in FIGS. 15B and 15D. Also, while a simple rectangular extension tab advantageously reduces the cost to manufacture, a tapered extension tab as shown in FIG. 17A or a contoured tab as shown in FIG. 17B, shown only in the context of an enhanced locking element but also applicable to enhanced hybrid element, can provide the locking action between the enhanced panel connector and the corresponding connector. Similarly, as would be recognized by those skilled in the art, the extension tab thickness is governed by the design strength, and may be thinner or thicker than the protruding tab.

Figure 18A:
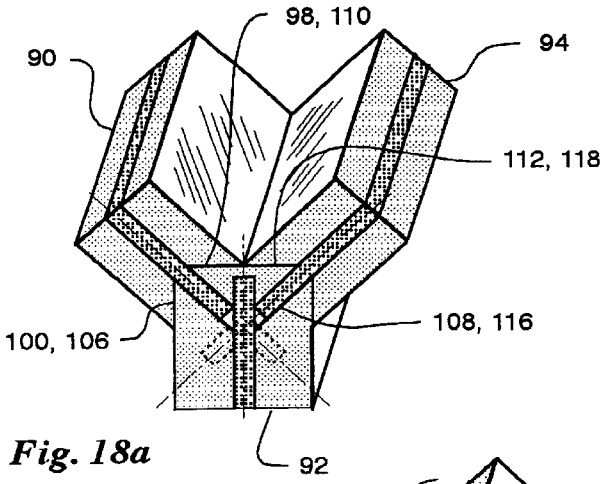
FIG. 18A is a schematic perspective view of an assembled three-panel interconnection of stiffened panel connectors.
Figure 18B:
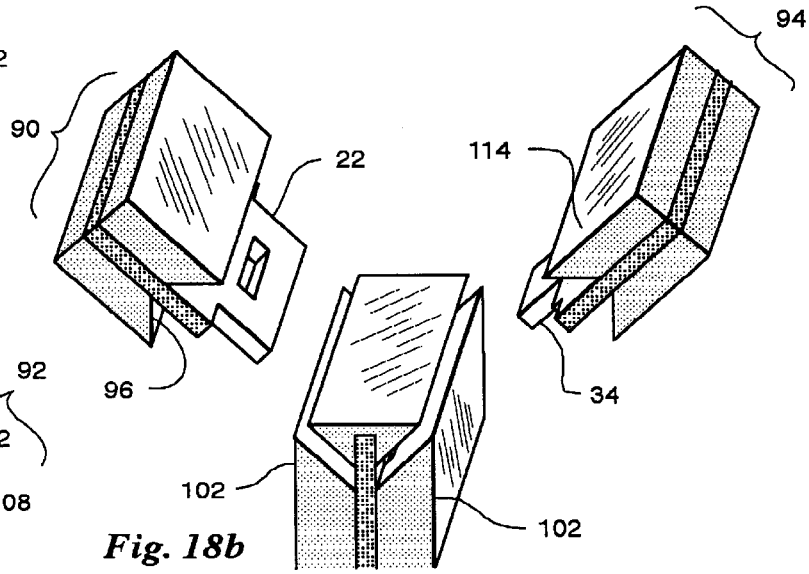
FIG. 18B is an exploded perspective view of the three-panel interconnection of FIG. 18A.

FIG. 18A illustrates an assembled view of a third separate embodiment of a system for interconnecting panels that includes a stiffened hybrid connector 90, stiffened receptor connector 92 and stiffened locking connector 94. FIG. 18B is an exploded view of the stiffened panel connector system of FIG. 18A.

Figure 19:
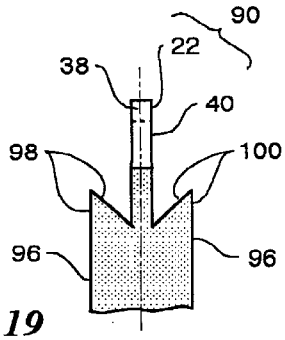
FIG. 19 is a cross sectional view of a stiffened hybrid connector.

A stiffened hybrid connector 90 includes a hybrid connector element 22, and a hybrid stiffener 96 as seen in FIG. 19. The hybrid connector element 22 has a base edge 36, a protruding tab 38, and an aperture 40 as previously disclosed above. Here, the hybrid stiffener 96 is arranged on both sides of the hybrid connector element 22 and includes a first and second interfitting profiles 98, 100 for fitting into corresponding profiles of the stiffened receptor connector 92.

Figure 20:
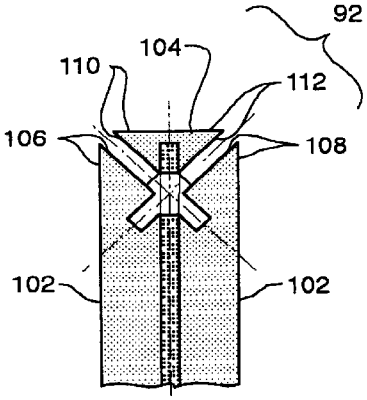
FIG. 20 is a cross sectional view of a stiffened receptor connector.

The stiffened receptor connector 92 includes a receptor connector element 28, a receptor stiffener 102, and spline 104 as seen in FIG. 20. The receptor connector element 28 includes a base edge 50 and an aperture 52 as previously discussed. Here, the receptor stiffener 102 is arranged on both sides of the receptor connector element 28 and includes third and fourth interfitting profiles 106, 108. The spline 104 positioned centrally and attached to the base edge 50 includes fifth and sixth interfitting profiles 110 and 112 as shown in FIG. 20. In the arrangement illustrated in FIG. 20, the first and second interfitting profiles 98 and 100 of the stiffened hybrid connector 90 fits with the third and fifth interfitting profiles 106 and 110. The fourth and sixth interfitting profiles 108 and 112 of the stiffened receptor connector 92 fit into corresponding profiles of the stiffened locking connector 94.

Figure 21:
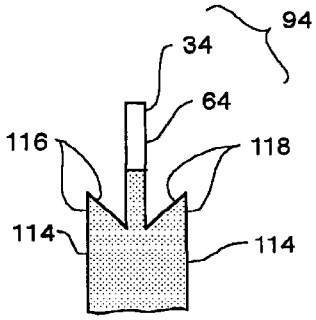
FIG. 21 is a cross sectional view of a stiffened locking connector.

The stiffened locking connector 94 includes a locking connector element 34 and a locking stiffener 114 as seen in FIG. 21. The locking connector element 34 has a base edge 62 and a protruding tab 64 as previously disclosed above. Here, the locking stiffener 114 is arranged on both sides of the locking connector element 34 and includes a seventh and eighth interfitting profiles 116, 118 for fitting into corresponding fourth and sixth interfitting profiles 108, 112 of the stiffened receptor connector 92.

Referring again to FIG. 18A the stiffened panel connectors are shown interconnected according to the present invention. The mating sequence is as previously disclosed. The stiffened hybrid connector 90 is mated with the stiffened receptor connector 92 such that the hybrid connector aperture 40 is accessible from the second side of the receptor element. This first mating step also fits the first and second interfitting profiles 98, 100 with the third and fifth interfitting profiles 106, 110. The stiffened locking connector 94 is then mated with the sub-assembly by inserting the locking tab 64 into the hybrid connector aperture 40. This second mating step also fits the seventh and eighth interfitting profiles 116, 118 with the fourth and sixth interfitting profiles 108, 112. As illustrated in FIG. 18A, once mated, the panel connector elements interconnect the stiffened panel connectors together and the interfitted profiles fill the spaces between the panel connectors. The space filling feature of the interfitted profiles advantageously reduces the need to insulate the interconnection, assists in repelling foreign matter from crossing from one side of the panel to another, and resists relative panel connector rotation where rotation is not needed during panel interconnection.

The panel stiffener may be integrally cast or formed with the connector element or machined from common stock as will be evident to those skilled in the art. Alternatively, the panel stiffener may be a separate layer of material secured to the connector element by adhesive or standard fasteners known in the art such as, for example, nails, screws, or staples. The stiffened locking connector 94 may also be comprised of an enhanced locking element 76 in place of the standard locking element 34. The assembly of the stiffened locking connector 94 having the enhanced locking connector 76 is according to the sequence as previously described.

Figure 22:
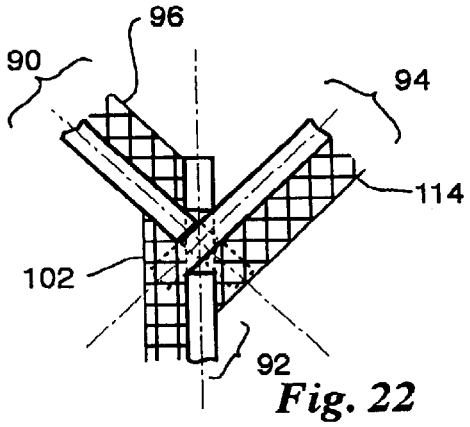
FIG. 22 is a cross sectional view of a three-panel interconnection of stiffened panel connectors having asymmetrical stiffeners.
Figure 23:
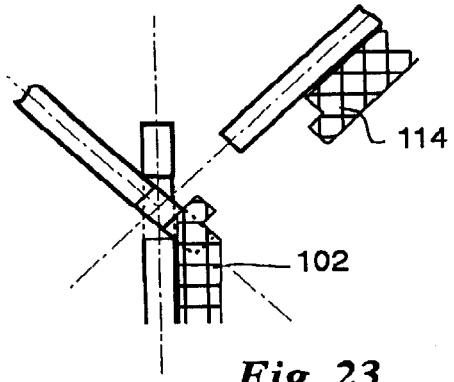
FIG. 23 is a cross sectional view of panels with stiffeners having an alternate intermitting profile configuration.

Furthermore, though the preferred stiffener portions 96, 102, 114 shown has the connector element centrally located about two interfitting profiles, a single interfitting profile may be provided on one side of the connector element as shown in FIG. 22 and still provide effective insulation or resistance to contamination at the interconnection. Also, though the preferred interfitting profile is bevel-shaped as shown in FIGS. 18A and 18B, those skilled in the art will recognize other matching interfitting shapes, such as an orthogonal slot and groove as shown in FIG. 23, may be used. The simple bevel shape, however, advantageously reduces the cost of manufacture while effectively practicing the present invention.

Figure 24:
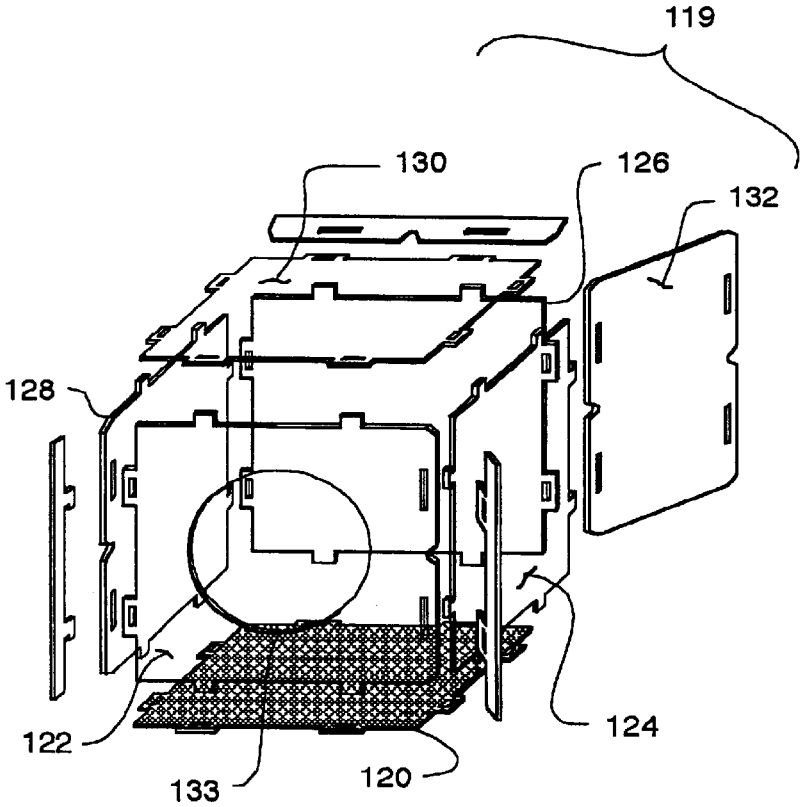
FIG. 24 is an exploded perspective view of a modular structure.

A modular structure in accordance with the present invention will now be disclosed. A representative fully assembled module 119, which may itself be deemed a modular structure, is illustrated in FIG. 1. FIG. 24 is an exploded view of the modular structure 119 that includes a bottom panel 120, side panels 122, 124, 126, 128, top panel 130, and expansion panel 132. Though not every perimeter needs to have a panel connector, where an interconnection is to be made, a panel connector must be provided.

The construction of the modular structure of FIG. 24 will now be described. The bottom panel 120 may be configured with a hybrid connector 20 such as shown in FIG. 4 on every perimeter. A first side panel 122 is selected having a locking connector 32 such as shown in FIG. 8 along the panel edge that is to interconnect with the bottom panel 120. The first side panel 122 is then interconnected to the bottom panel 120 using a stand-alone receptor connector (not shown) according to the present invention already discussed. It should be noted that the panel connectors adapted to the bottom panel, side panel and standing connector are arbitrary. This first interconnection may easily be accomplished by alternatively using a bottom panel having a receptor connector, a side panel having a locking connector and a stand-alone hybrid connector.

Next, a second side panel 124 is selected having suitable panel connector to interconnect to the first side panel 122 and the bottom panel 120. As these interconnections are two-panel interconnections, an appropriate stand-alone connector may be used. Hence, by selecting panels with appropriate connectors and systematically interconnecting panels as described above, a modular structure may be assembled. Note that in circumstances where relative panel displacement is unlikely, a stand-alone connector may not be necessary to provide a secure two-panel interconnection. For example, in circumstances where a side panel having an enhanced locking connector is interconnected to a side panel having a hybrid connector, use of a stand-alone receptor connector may not be needed if the extension tab engagement may be sufficient to secure the two panels in place.

Interconnection of separate modular structures can be accomplished by employing a three-panel interconnection. Referring again to FIGS. 1 and 24, the three-panel interconnection of panels 124, 126 and 132 provides panel 132 as a starting panel for a second module 121 that is interconnected to the first module 119.

Although rectangular panels have been illustrated to describe the details of the present invention, those skilled in the art will recognize that the panel interconnection system of the present invention is not limited to a particular panel geometry. The panel connectors of the present invention may be adapted to any panel shape such as, but not limited to rhombuses, trapezoids, parallelograms, circles, triangles or hexagons. Hence, with the myriad of panel shapes that are available in addition to the various angular orientation the panel connectors can accommodate, the present invention provides the capacity to construct complex space filling geometries.

Additionally, the panel may have cutouts for windows, doors, screens or other functional qualities, such as the rounded cutout 133 shown in FIG. 24. Also, the panels may have artistic impressions, patterns or other aesthetic qualities as shown in FIGS. 25A and 25B. Furthermore, the panel thickness may vary from the connector elements. For example, as shown in FIG. 26, panels adapted to the connector elements may be thickened with insulation or other materials.

The embodiments disclosed according to the present invention are applicable for various purposes. As directed to play equipment, toys or models, the stiffened and non-stiffened panel connectors may be fabricated from durable plastic, wood or other suitable materials or combination of materials known in the art. As directed to habitable or commercial structures, the panel connector may be cast or machined metal, wood, plastic composites or a combination of these or similarly available materials known in the art. In either application, the panel connector may be a free standing unit, integral to a panel or separable and attached to the panel by adhesive or other securing means known in the art.

The panel to which the panel connector of the present invention may be adapted or attached, may be composed of a single layer made of wood, drywall, plastic, composite, or other material suitable for construction purposes. The panel may also be composed of multiple layers of materials such as wood, insulation, drywall, plastic, composite, or any combination of these or other suitable materials known in the art.

Thus, novel panel interconnection systems and methods, and structures comprising the system have been shown and described. Various modifications may, of course, be made, without departing from the spirit and scope of the invention. The invention, therefore, should not be limited, except by the following claims and their equivalents.

What is claimed is:

1. A system for interconnecting modular construction panels, the system comprising:

a hybrid connector having a first base edge and a first protruding tab, the first protruding tab extending outwardly from the first base edge and defining a first aperture, said first protruding tab having first side edges and a first outer edge, the first side edges being generally orthogonal to the first base edge, said first protruding tab including an extension tab extending generally parallel to and offset from the first base edge and generally orthogonal to said first side edges;

a receptor connector defining a second aperture;

a locking connector having a second protruding tab; and wherein the first protruding tab is designed to mate with the second aperture, and the second protruding tab is designed to mate with the first aperture.

2. The system of claim 1 wherein the first aperture has long edges generally parallel to the first base edge and short edges generally orthogonal to the first base edge.

3. The system of claim 1, wherein the receptor connector has a second base edge, and the second aperture has long edges generally parallel to the second base edge and short edges generally parallel to the second base edge.

4. The system of claim 1 wherein the locking connector has a third base edge, the second protruding tab has second edges and a second outer edge, and the second side edges are generally orthogonal to the third base edge.

5. The system of claim 1 wherein at least two of the hybrid connector, the receptor connector, and the locking connector are adapted to joinably associating construction panels.

6. A system for interconnecting modular construction panels, the system comprising:

a hybrid connector having a first protruding tab, the first protruding tab defining a first aperture;

a receptor connector defining a second aperture;

a locking connector having a second protruding tab and a third base edge, the second protruding tab having second side edges and a second outer edge, and the second side edges being generally orthogonal to the third base edge, the second protruding tab including an extension tab, the extension tab extending generally parallel to and offset from the third base edge, and the extension tab extending generally orthogonal to the second side edge; and wherein the first protruding tab is designed to mate with the second aperture, and the second protruding tab is designed to mate with the first aperture.

7. The system of claim 6 wherein at least two of the hybrid connector, the receptor connector, and the locking connector are adapted to joinably associating construction panels.

8. A system for interconnecting modular construction panels, the system comprising:

a hybrid connector having a first protruding tab and first stiffening portion, the first protruding tab defining a first aperture, said first stiffening portion including a first interfitting profile and a second interfitting profile, said first interfitting profile being located on one side of said first protruding tab, and said second interfitting profile being located on a second side of said first protruding tab;

a receptor connector having a second aperture and a second stiffening portion, the second aperture being offset from a base edge; and a locking connector having a second protruding tab and a third stiffening portion;

wherein the first protruding tab is designed to mate with the second aperture, and the second protruding tab is designed to mate with the first aperture.

9. The system of claim 8, wherein the first and second interfitting profiles are designed to interfit with the receptor connector.

10. The system of claim 8 wherein the first and second interfitting profiles are designed to interfit with the locking connector.

11. A system for interconnecting modular construction panels, the system comprising:

a hybrid connector having a first protruding tab and first stiffening portion, the first protruding tab defining a first aperture;

a receptor connector having a second aperture and a second stiffening portion, the second aperture being offset from a base edge, said second stiffening portion including a third interfitting profile and a fourth interfitting profile, said third interfitting profile being located on a first side of said second aperture, said fourth interfitting profile being located on a second side of said second aperture; and a locking connector having a second protruding tab and a third stiffening portion;

wherein the first protruding tab is designed to mate with the second aperture, the second protruding tab is designed to mate with the first aperture, the third interfitting profile is designed to interfit with the hybrid connector, and the fourth interfitting profile is designed to interfit with the locking connector.

12. The system of claim 11, wherein the receptor connector has a spline, the spline is adapted to the base edge, the spline includes a fifth interfitting profile and a sixth interfitting profile, the fifth interfitting profile is designed to interfit with the hybrid connector, and the sixth interfitting profile is designed to interfit with the locking connector.

13. A system for interconnecting modular construction panels, the system comprising:

a hybrid connector having a first protruding tab and first stiffening portion, the first protruding tab defining a first aperture;

a receptor connector having a second aperture and a second stiffening portion, the second aperture being offset from a base edge; and a locking connector having a second protruding tab and a third stiffening portion, said third stiffening portion including a seventh interfitting profile and an eighth interfitting profile, the seventh interfitting profile being located on a first side of the second protruding tab, and said eighth interfitting profile being located on a second side of said second protruding tab;

wherein the first protruding tab is designed to mate with the second aperture, and the second protruding tab is designed to mate with the first aperture.

14. The system of claim 13 wherein the seventh and eighth interfitting profiles are designed to interfit with the receptor connector.

15. The system of claim 13, wherein the seventh interfitting profile is designed to interfit with the receptor connector, and the eighth interfitting profile is designed to interfit with the hybrid connector.

16. A modular construction system comprising:

a hybrid connector having a first base edge;

a hybrid tab integral with said hybrid connector and protruding outwardly of and in a generally orthogonal direction to said first base edge, said hybrid tab having a hybrid aperture therethrough, said hybrid aperture being disposed generally outwardly of said first base edge;

a receptor connector having a second base edge and a receptor aperture therethrough, said receptor aperture being disposed inwardly of said second base edge;

a locking connector having a third base edge;

a locking tab integral with said locking connector and protruding outwardly of and in a generally orthogonal direction to said third base edge; and at least first and second construction panels, each of said first and second construction panels including at least one of said hybrid, receptor, or locking connectors, at least a first of said connectors on said first construction panel being different from and adapted to interpenetrate a second of said connectors on said second construction panel to form a joint wherein the respective base edges of said first and second connectors extend generally parallel and adjacent to one another, a third of said connectors being adapted to engage with and secure said joint with the base edge of said third connector extending generally adjacent and parallel to the base edges of said first and second connectors.

17. A modular construction system of claim 16 including a third construction panel including said third connector.

18. A modular construction system of claim 16 wherein said first connector is a said hybrid connector, and said second connector is a said receptor connector.

19. A modular construction system comprising:

a hybrid connector having a generally planar form bounded by a first base edge;

a hybrid tab integral with said hybrid connector and protruding outwardly of and in a generally orthogonal direction to said first base edge, said hybrid tab having a hybrid aperture therethrough, said hybrid aperture being disposed generally outwardly of said first base edge;

a receptor connector having a second base edge and a receptor aperture therethrough, said receptor aperture being disposed inwardly of said second base edge and adapted to receive said hybrid tab therethrough with said first base edge at a location inwardly of said second edge;

a locking connector having a third base edge;

a locking tab integral with said locking connector and protruding outwardly of and in a generally orthogonal direction to said third base edge, said locking tab being adapted to being received through said hybrid aperture with said third base edge generally parallel to said first and second base edges.

20. A modular construction system comprising:

a first connector panel having a first base edge;

a hybrid tab integral with said first connector panel and protruding outwardly of and in a generally orthogonal direction to said first base edge, said hybrid tab having a hybrid aperture therethrough, said hybrid aperture being disposed generally outwardly of said first base edge;

a second connector panel having first and second sides, a second base edge, and a receptor aperture therethrough, said receptor aperture being disposed inwardly of said second base edge, said receptor aperture being adapted to receive said hybrid tab therethrough;

a third connector panel having a third base edge;

a locking tab integral with said third connector panel and protruding outwardly of and in a generally orthogonal direction to said third base edge, said hybrid aperture being adapted to receive said locking tab therethrough with said first base edge being disposed generally on said first side and said third base edge being disposed generally on said second side.

21. A method of constructing a modular construction system comprising:

selecting a first connector panel having a first base edge and a hybrid tab integral therewith and protruding outwardly of and in a generally orthogonal direction to said first base edge, said hybrid tab having a hybrid aperture therethrough, said hybrid aperture being disposed generally outwardly of said first base edge;

selecting a second connector panel having first and second sides, a second base edge, and a receptor aperture therethrough, said receptor aperture being disposed inwardly of said second base edge, said receptor aperture being adapted to receive said hybrid tab therethrough;

selecting a third connector panel having a third base edge and a locking tab integral therewith and protruding outwardly of and in a generally orthogonal direction to said third base edge; and inserting said locking tab through said hybrid aperture with said first base edge being disposed generally on said first side and said third base edge being disposed generally on said second side.

* * * * *